United States Patent [19]

Tao et al.

[11] Patent Number: 4,519,775

[45] Date of Patent: May 28, 1985

[54] BURNER APPARATUS

[75] Inventors: Muneo Tao; Fumihiko Migaki, both of Yamatokoriyama, Japan

[73] Assignee: Matsushita Electric Industrial Co., Ltd., Kodoma, Japan

[21] Appl. No.: 464,118

[22] Filed: Feb. 4, 1983

[30] Foreign Application Priority Data

Feb. 10, 1982 [JP] Japan ..... 57-20003

[51] Int. Cl.[3] ..... F24C 5/04; F23D 13/04

[52] U.S. Cl. ..... 431/344; 126/96; 126/97

[58] Field of Search ..... 126/96, 93, 214 D, 45, 126/97; 431/298, 299, 300, 310, 312, 313, 314, 303, 304, 344

[56] References Cited

U.S. PATENT DOCUMENTS

| | | | |
|---|---|---|---|
| 146,351 | 1/1874 | Mason | 126/83 |
| 706,996 | 8/1902 | Oblinger | 126/83 |
| 877,871 | 1/1908 | Snitjer | 126/83 |
| 1,945,966 | 2/1934 | Brackett | 126/96 |
| 3,085,563 | 4/1963 | Murphy | 126/96 |
| 4,357,929 | 11/1982 | Johnson | 126/96 |

FOREIGN PATENT DOCUMENTS

| | | | |
|---|---|---|---|
| 14969 | 4/1980 | Japan . | |
| 68519 | 5/1980 | Japan | 126/96 |
| 68520 | 5/1980 | Japan | 126/96 |
| 430553 | 6/1935 | United Kingdom | 126/96 |

*Primary Examiner*—Samuel Scott
*Assistant Examiner*—Carl D. Price
*Attorney, Agent, or Firm*—Stevens, Davis, Miller & Mosher

[57] ABSTRACT

Provided is a burner apparatus comprising a cabinet, a combustion cylinder disposed in the cabinet, a top panel disposed above the combustion cylinder and provided with exhaust holes formed in the peripheral portion thereof, a flame-shielding member with the lower surface thereof opened, provided to a portion of the lower surface of the top panel facing the combustion cylinder, and discharge means provided to the flame-shielding member for horizontally discharging flames rising from the combustion cylinder and streaming into the flame-shielding member, thereby averting the problem of flames undesirably coming out of the cabinet.

3 Claims, 8 Drawing Figures

BURNER APPARATUS

TECHNICAL FIELD

The present invention relates to burner apparatus, such as kerosine stoves and gas stoves, and more particularly to burner apparatus made free from the danger of flames extending outside the apparatus, above the top panel thereof.

BACKGROUND ART

In conventional burner apparatus, such as kerosene stoves, in which a wick is used and combustion is maintained by means of natural draft, there are possibilities that flames upwardly extend from the combustion cylinder of the apparatus to come out above the top panel thereof, which may result in a fire, in the following occasions:

a. when the wick is drawn out to its maximum height and left as it is;
b. when wind blows to cause turbulence in combustion; and
c. when the wick height is changed quickly from an ordinary height or relatively low height to the maximum height. In order to obviate the above-mentioned problem, a flame-shielding plate with the simplest shape is conventionally attached to the lower surface of the top panel, as shown in Japanese Utility Model Publication No. 14969/80.

An example of prior arts will be described hereinunder with reference to the accompanying drawings. In FIGS. 1 through 3, a reference numeral 1 denotes a box-shaped cabinet with its front side opened, while a numeral 2 denotes a lower-surface reflection plate partitioning the inside of the cabinet 1 into upper and lower parts. A fuel tank 3 arranged in the space of the lower part has cylindrical wick guides 4, 5 projected from the upper part thereof and a cylindrical wick 6 vertically movably fitted between the wick guides 4, 5. Moreover, the fuel tank 3 is provided with an operation knob 7 for vertically moving the wick 6. A reference numeral 8 denotes a known combustion cylinder comprising three cylindrical elements mounted on the wick guides 4, 5. The combustion cylinder 8 has a hemispherical radiating net 9 in the upper part thereof. A square plate-shaped top panel 10 formed above the combustion cylinder 8 has a plurality of exhaust holes 11 formed in its peripheral portion around the central portion thereof facing the combustion cylinder 8. In addition, a flame-shielding member 12 attached to the lower surface of the substantially central portion of the top panel 10 is in the shape of a cylinder and has the upper end thereof brought into contact with the lower surface of the top panel 10 without any space left. In this conventional arrangement, when the wick 6 is upwardly projected to its maximum height and left as it is, flames upwardly extending from the radiating net 9 once enter the flame-shielding member 12. However, since there is no space between the flame-shielding member 12 and the top panel 10, the flames collide against the top panel 10 to become energetic so as to scramble up the lower part of the flame-shielding member 12 as shown by an arrow in FIG. 3, so that the successive flames will not enter the flame-shielding member 12. Eventually, the flames undesirably come out through the exhaust holes 11 of the top panel 10, bringing about a very dangerous state. One way to resolve such a problem, is to increase the flame-shielding member 12 in height. In this case, however, such problems will arise in other respects that, for example, a catalyst cannot be installed above the combustion part since there is no sufficient space between the combustion part and the flame-shielding member 12. The above-mentioned phenomenon is remarkable, particularly when the stretch of flames is large and this condition is maintained in such a case where the height of the wick 6 is abruptly increased during combustion.

DISCLOSURE OF THE INVENTION

It is, therefore, an object of the present invention to improve the flame-shielding member by providing a discharge means for horizontally discharging the flames rising from the combustion cylinder and streaming into the flame-shielding member, thereby averting the above-mentioned danger.

Preferred embodiments of the invention will be described hereinunder with reference to the accompanying drawings.

Figure 1:
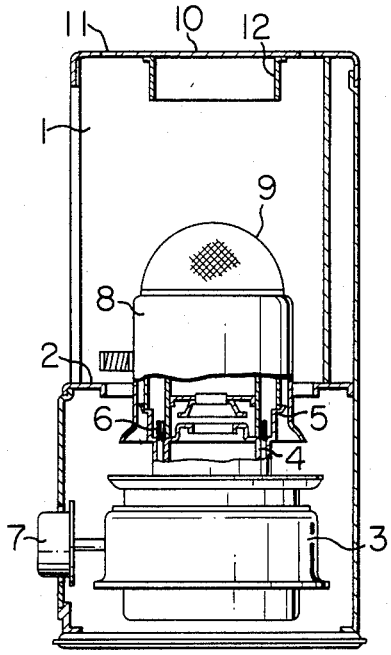
FIG. 1 PRIOR ART
FIGS. 1 thru 3 are a sectional view, plan view and front elevational view of an example of prior art, respectively.
Figure 2:
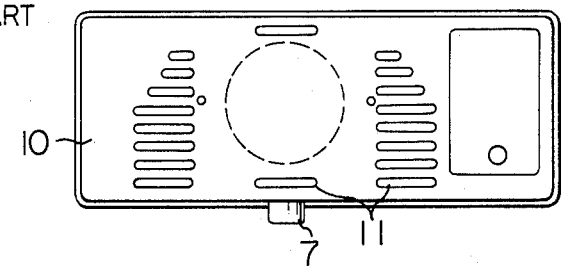
FIG. 2 PRIOR ART
Figure 3:
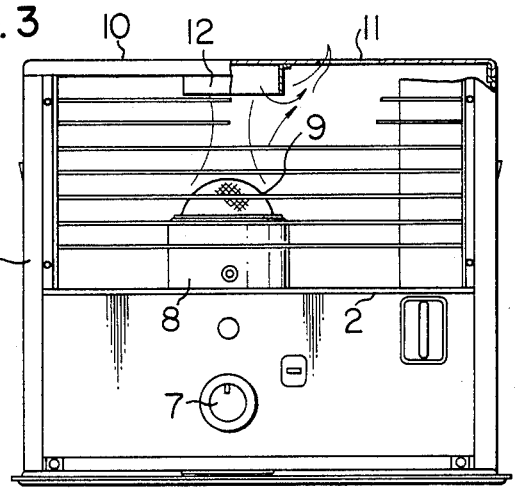
FIG. 3 PRIOR ART
Figure 4:
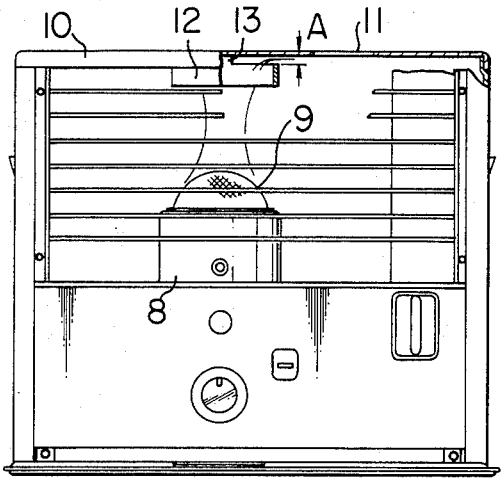
FIG. 4 is a front elevational view of a preferred embodiment of the invention.
Figure 5:
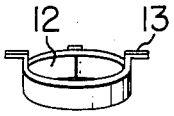
FIG. 5 is a perspective view of a flame-shielding member of the preferred embodiment shown in FIG. 4.

THE BEST MODE FOR CARRYING OUT THE INVENTION,

In a preferred embodiment of the invention, as shown in FIGS. 4 and 5, the top panel 10 having the exhaust holes 11 formed in the peripheral portion thereof is provided above the combustion cylinder 8, and the cylindrical flame-shielding member 12 is connected, by means of spot welding or the like, to the lower surface of the substantially central portion of the top panel 10 facing the combustion cylinder 8 with a given space A being left between the flame-shielding member 12 and the top panel 10. A reference numeral 13 designates each of legs for welding. In this arrangement, the flames upwardly extending from the radiating net 9 enter the flame-shielding member 12 as shown in FIG. 5 and pass through the space A defined by the top panel 10 and the flame-shielding member 12 other than the legs 13 for attaching the flame-shielding plate. In other words, by providing the space A, which constitutes a discharge means, flames successively enter the flame-shielding member 12 as well as become settled steady flames when passing through the space A and are discharged in the horizontal direction. Consequently, the flames never reach the exhaust holes 11 and never leak upwardly from the exhaust holes 11, thereby making it possible to eliminate any danger of fire. Moreover, the flame-shielding member 12 is low in height; therefore, a catalyst or the like can be installed under the flame-shielding member 12. It is to be noted that it is possible to obtain a similar effect if the flame-shielding member 12 is formed into a tubular shape by employing a punched plate instead of providing the space A. In such a case, however, the cost becomes higher partly because a large number of punched holes are required, and moreover, since the top panel 10 is generally enameled, the punched holes are liable to be easily clogged by painting, which also results in increase in the cost. Therefore, if the space is provided in such a way as described in this embodiment, machining and the shape are simple, so that the cost is lower, and the space A eliminates the enamel clogging.

Figure 6:
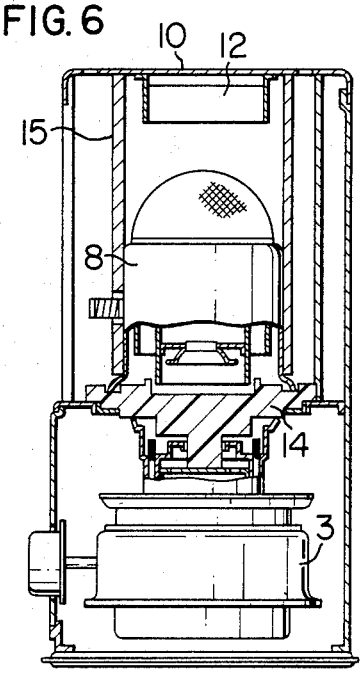
FIG. 6 is a sectional side elevational view of the preferred embodiment of the invention.

Next, FIG. 6 shows a packaging form on shipment. Namely, in order to prevent deformation of the combustion cylinder 8 and the top panel 10 or the like due to a downward force applied thereto when something falls or someone steps thereon, the combustion cylinder 8 is mounted on a circular protection material 14 which is made of foaming polystyrol or the like and supported by the fuel tank 3. Moreover, the upper end of a tubular packaging member 15 is brought into contact with the lower surface of the top panel 10, while the lower end of the packaging member 15 is brought into contact with the skirt part of the lower part of the combustion cylinder 8. The packaging member 15 is a material with cushioning properties, such as a corrugated board, which is wound around the combustion cylinder 8 and fixed at the front by means of an adhesive tape or the like so as to reinforce the combustion cylinder 8. Accordingly, the diameter of the flame-shielding member 12 is formed so as to be smaller than that of the combustion cylinder 8 according to the packaging work and form.

Figure 7:
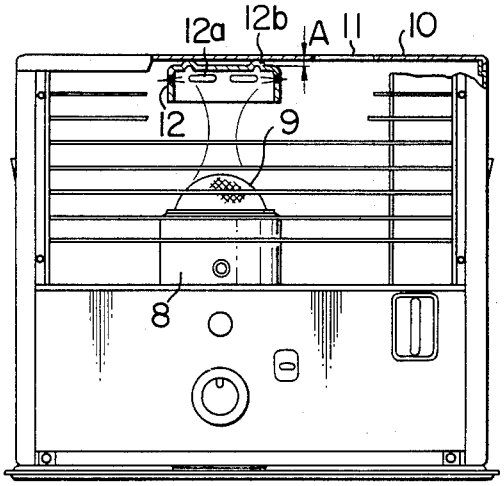
FIG. 7 is a front elevational view of another preferred embodiment of the invention.
Figure 8:
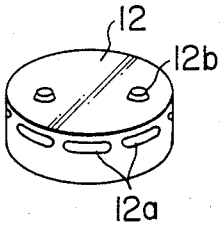
FIG. 8 is a perspective view of a flame-shielding member of the preferred embodiment shown in FIG. 7.

FIGS. 7 and 8 show another preferred embodiment, which can overcome such disadvantages of the prior art that the flame-shielding member 12 causes heat to be concentrated on the central portion of the top panel 10, so that a partial warp or thermal deformation is produced, and so that a treated steel plate such as an aluminum-plated steel plate cannot be employed as the top panel because of discoloration. In this embodiment, as shown in FIGS. 7 and 8, the top panel 10 having the exhaust holes 11 formed in the peripheral portion of the center part thereof is provided above the combustion cylinder 8 employed as an example of the combustion part. Moreover, the flame-shielding member 12 formed in the shape of a cylinder with a top and having openings 12*a* formed in the peripheral wall thereof is provided to the lower surface of the substantially central portion of the top panel 10 facing the combustion cylinder 8. It is to be noted that the flame-shielding member 12 has projections 12*b* formed on the top surface thereof for maintaining the given space A between the top of the flame-shielding member 12 and the lower surface of the top panel 10, and the flame-shielding member 12 is fixed thereto by means of screwing, spot welding or the like by the use of the projections 12*b*.

In this arrangement, the flames upwardly extending from the hemispherical radiating net 9 enter the flame-shielding member 12 and horizontally pass through the openings 12*a* formed in the peripheral wall thereof, as shown in FIG. 7. In other words, a discharge means is constituted by forming the openings 12*a* in the peripheral wall of the flame-shielding member 12. Thereby, flames enter the flame-shielding member 12 and become settled as tidy and steady flames when horizontally passing through the openings 12*a*, so that the flames never reach the exhaust holes 11, and the danger of fire is eliminated. Moreover, since the flame-shielding member 12 is low in height, a catalyst or the like can be installed. Further, since the top panel 10 and the flame-shielding member 12 are only partially brought into contact with each other through the projections 12*b* and since the flame-shielding member 12 has the given space A between the same and the top panel 10, the flame-shielding member 12 also serves as a heat-shielding plate for the top panel 10, thereby making it possible to eliminate the possibilities of warp, thermal deformation, discoloration or the like of the top panel 10.

INDUSTRIAL APPLICABILITY

As will be apparent from the foregoing description, according to the invention, it is possible to avert the danger of flames extending outside the apparatus, above the top panel thereof.

What is claimed is:

1. A burner apparatus comprising:

a cabinet;

a combustion cylinder disposed in said cabinet;

a top panel having a lower surface disposed above said combustion cylinder and exhaust holes formed in a peripheral portion thereof;

a flame-shielding member attached to a portion of the lower surface of said top panel facing said combustion cylinder; and a discharge means associated with said flame-shielding member for horizontally discharging flames rising from said combustion chamber and streaming into said flame-shielding member, said flame-shielding member having an open bottom cylinderical shape and a peripheral wall and a top closed by a top wall which is spaced from said portion of the lower surface of said top panel by means providing a predetermined gap, said discharge means including at least one opening formed in said peripheral wall of said flame-shielding member.

2. A burner apparatus according to claim 1, wherein said top wall of said flame-shielding member has said means for providing said predetermined gap including a plurality of projections having tops abutted against said portion of the lower surface of said panel, to define said predetermined gap between said top wall of said flame-shielding member and said portion of the lower surface of said top panel.

3. A burner apparatus according to claim 2 wherein said flame-shielding member has a diameter which is smaller than an outside diameter of said combustion cylinder.

* * * * *